US005647158A

United States Patent [19]

Eskelinen et al.

[11] Patent Number: 5,647,158

[45] Date of Patent: Jul. 15, 1997

[54] GUN TRIGGER LOCK

[76] Inventors: Conrad W. Eskelinen, 33682 Jefferson Ct., Farmington Hills, Mich. 48335; Ivan M. Bucko, 571 Renaud St., Gross Point Woods, Mich. 48236

[21] Appl. No.: 526,823

[22] Filed: Sep. 11, 1995

[51] Int. Cl.[6] ..... F41A 17/00

[52] U.S. Cl. ..... 42/70.07; 42/70.06

[58] Field of Search ..... 42/70.07, 70.06; 89/138

[56] References Cited

U.S. PATENT DOCUMENTS

| | | | |
|---|---|---|---|
| 1,686,482 | 10/1928 | Windle | 42/70.07 |
| 2,444,649 | 7/1948 | Jacobs | 42/70 |
| 3,624,945 | 12/1971 | Foote | 42/1 Y |
| 3,956,842 | 5/1976 | Ballenger | 42/1 Y |
| 4,030,221 | 6/1977 | Doobenen et al. | 42/1 Y |
| 4,084,340 | 4/1978 | Scudder | 42/1 N |
| 4,084,341 | 4/1978 | Cervantes | 42/1 Y |
| 4,226,399 | 10/1980 | Henderson | 248/553 |
| 4,299,045 | 11/1981 | Cervantes | 42/1 Y |
| 4,398,366 | 8/1983 | Wernicki | 42/1 LP |
| 4,509,281 | 4/1985 | Dreiling et al. | 42/1 Y |
| 4,970,881 | 11/1990 | Hsiao | 70/25 |
| 5,024,017 | 6/1991 | Nishioka | 42/70.07 |
| 5,109,684 | 5/1992 | Grandy | 70/25 |
| 5,153,360 | 10/1992 | Upton | 42/70.11 |
| 5,212,971 | 5/1993 | Yoon et al. | 70/165 |
| 5,235,763 | 8/1993 | Nosler et al. | 42/70.11 |
| 5,367,811 | 11/1994 | Sansom | 42/70.07 |

*Primary Examiner*—Charles T. Jordan
*Assistant Examiner*—Meena Chelliah
*Attorney, Agent, or Firm*—Lyman R. Lyon P.C.

[57] ABSTRACT

A trigger lock for a gun comprises a pair complimentary housings that overly opposite sides of the gun trigger guard. One of the housings has a connector shaft with a plurality of teeth thereon that extends through the trigger guard. The other of the housings has a latch plate with a plurality of teeth thereon engageable with the teeth on the connector shaft to effect locking of the housings to one another and to the gun. Each of the housings has an elastomeric pad that is compressible about the trigger of the gun to preclude movement thereof. The housings are separable from the gun upon opening of a lock and depression of a release button.

4 Claims, 3 Drawing Sheets

GUN TRIGGER LOCK

BACKGROUND OF THE INVENTION

The present invention relates generally to a gun safety device, and more particularly to a trigger lock for a gun that precludes accidental discharge thereof due to shock as well as access to the trigger.

Locks that preclude access to the trigger of a gun are well known. However, a common characteristic of known trigger locks is that movement of the trigger itself due to shock is not positively inhibited. As a result, careless handling of the gun as by, for example, dropping the gun, can result in movement of the trigger and firing of the gun due to shock. Moreover, known trigger locks generally are opened by a key which in an emergency situation may be difficult to find and/or insert into the lock mechanism.

SUMMARY OF THE INVENTION

A gun trigger lock in accordance with a preferred constructed embodiment of the present invention comprises a pair of opposed housings which are positioned on opposite sides of the trigger guard of a gun. The housings are complimentary to one another but are of different lateral and volumetric configuration, one of which houses a lock mechanism and the other of which supports a bolt that passes through the gun trigger guard. Movement of the trigger is positively restrained by a pair of elastomeric pads that are supported by the housings, respectively, so as to be compressed against one another and against the trigger itself thereby to totally fill the space internally of the gun trigger guard.

Removal of the trigger lock is initiated by dialing a combination lock as opposed to insertion of a key thereby eliminating the possibility of a misplaced key and the time required for insertion thereof into the lock mechanism.

Removal of the trigger lock and access to the trigger is achieved by pressing a release button by the thumb of the hand holding the gun. Ready access to the combination lock dial is afforded by the positioning thereof so as to be rotatable by the thumb on the free hand of the user.

DESCRIPTION OF THE PREFERRED EMBODIMENT OF THE INVENTION

Figure 1:
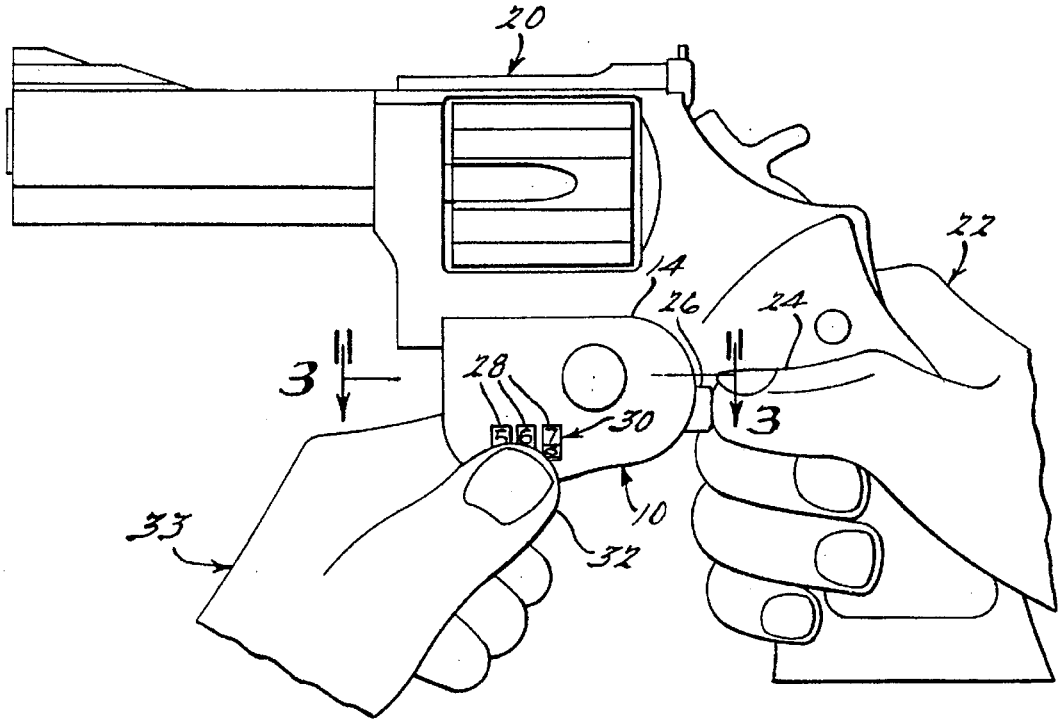
FIG. 1 is a side elevational view showing the gun trigger lock of the present invention mounted in position over the trigger guard of a gun.
Figure 2:
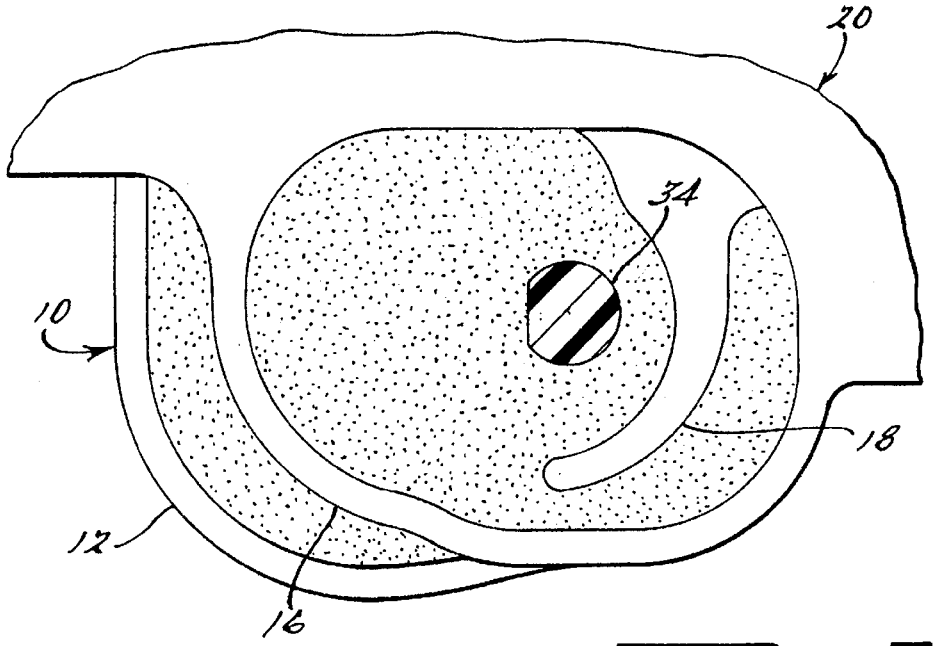
FIG. 2 is a side elevational view of the gun trigger lock with the lock support housing removed.

A gun trigger lock 10, in accordance with a preferred constructed embodiment of the present invention, comprises a pair of mating housings 12 and 14 adapted to be disposed on opposite sides of a trigger guard 16 and trigger 18 of a gun 20.

As seen in FIG. 1 the gun 20 is held in the right hand 22 of a user in which position the user's thumb 24 is positioned immediately behind a trigger lock release button 26 on the trigger lock 10. It is to be noted that when the gun 20 is held in the right hand 22 of the user, the indexing wheels 28*a*, 28*b*, and 28*c* of a combination lock 30 are positioned so as to be accessible for indexing by the thumb 32 on the left hand 33 of the user. Moreover, the wheels 28 of the lock 30 are positioned directly in front of the user for easy viewing.

Figure 3:
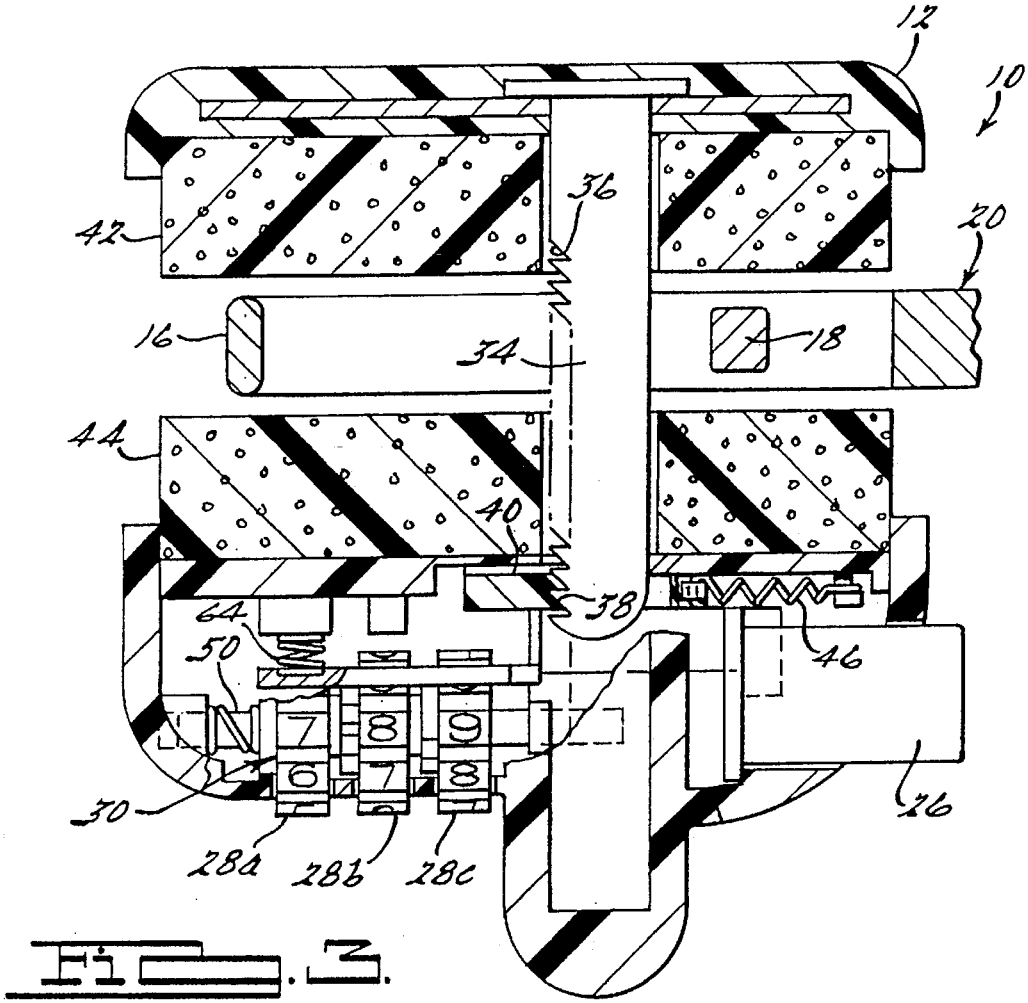
FIG. 3 is a view taken along the line 3—3 of FIG. 1 with the trigger lock partially installed on the gun.
Figure 5:
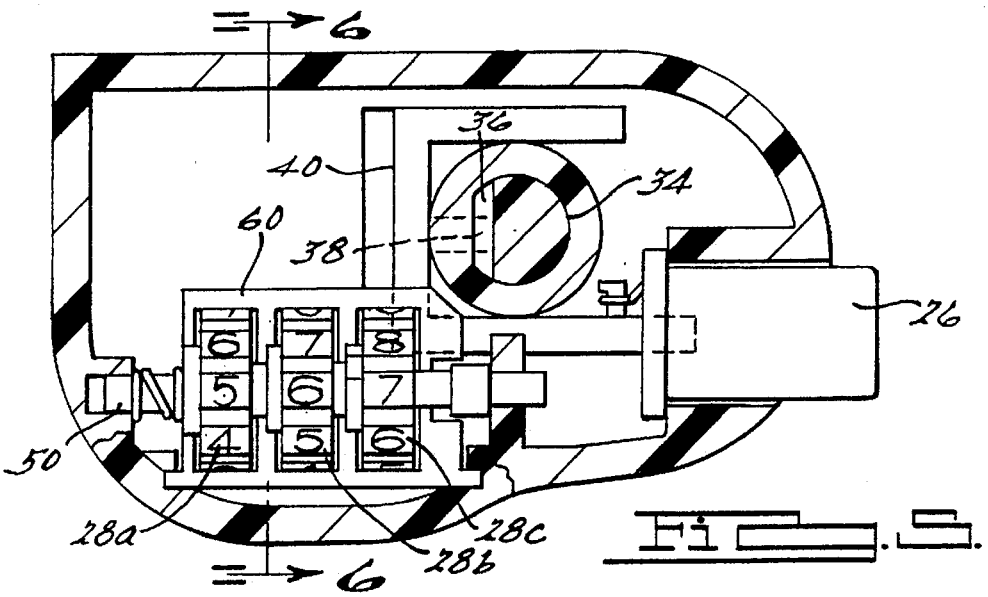
FIG. 5 is a view taken along the line 5—5 of FIG. 3.

As best seen in FIG. 3 of the drawing, the trigger lock 10 is shown in the partially assembled condition about the trigger guard 16 and trigger 18 of the gun 20. A connecting and locking shaft 34 is positively secured to the housing 12 of the lock 10 for insertion through the trigger guard 16 of the gun 18 forwardly of the trigger 18 thereof. The connecting shaft 34 is provided with a number of locking teeth 36 which are complimentary to teeth 38 on a latch plate 40. The latch plate 40 and its associated mechanism will be more fully discussed hereinafter.

Figure 4:
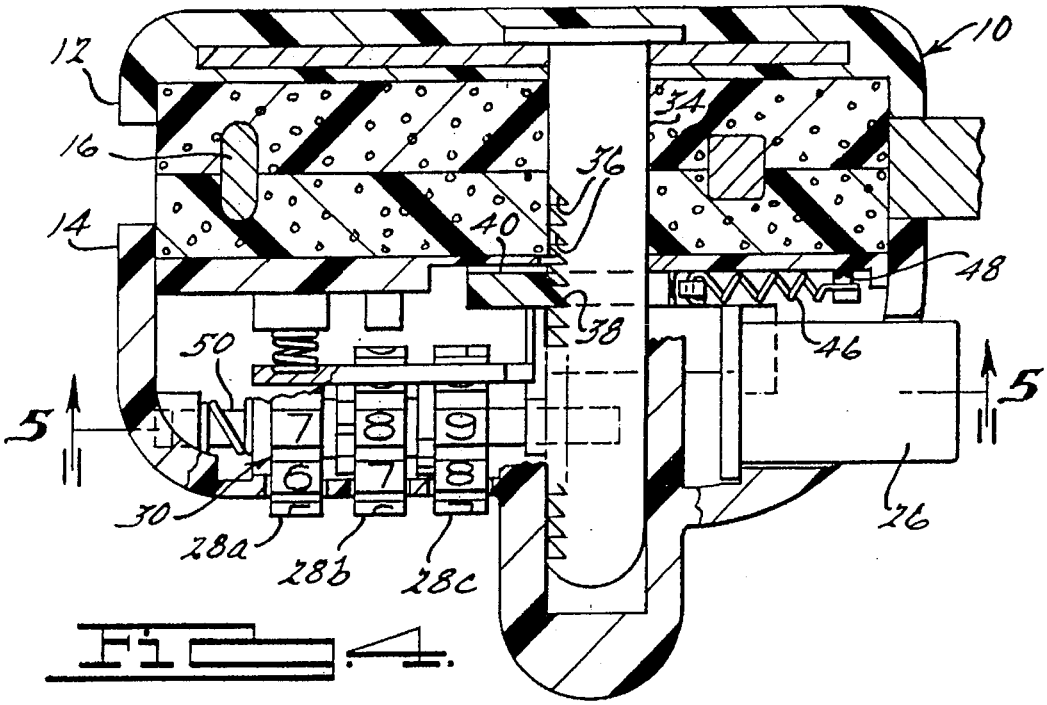
FIG. 4 is a view similar to FIG. 3 showing the trigger lock fully installed on the gun.

As best seen by comparing FIGS. 3 and 4, movement of the housings 12 and 14 toward one another and toward the trigger guard 16 and trigger 18 effects compression of a pair of elastomeric pads 42 and 44 in the housings 12 and 14, respectively. In a constructed embodiment of the invention, the pads 42 and 44 were formed from 52 durometer, Shore 00 scale, foam sold under the tradename "Superbounce 52" by Sentinel Products Corporation, Hyannis, Mass. The elastomeric pads 42 and 44 totally envelope the trigger guard 16 and trigger 18 of the gun 20 and are sufficiently dense to prevent movement of the trigger 18 relative to the guard 16. Specifically, envelopment of the trigger 18 by the elastomeric pads 42 and 44 is sufficient to preclude movement of the trigger due to shock incident to dropping of the gun 20.

As best seen in FIGS. 5 through 8, the housing 14 supports the combination lock 30 and release push button 24. Advancement of the housing 12 toward the housing 14 effects ratcheting engagement of the teeth 36 on the connecting shaft 34 with the teeth 38 on the latch plate 40. Movement of the latch plate 40 to the left to permit ratcheting of the teeth 36 and 38, is controlled by a tension spring 46 that extends between the latch plate 40 and an abutment 48 on the housing 14.

Figure 6:
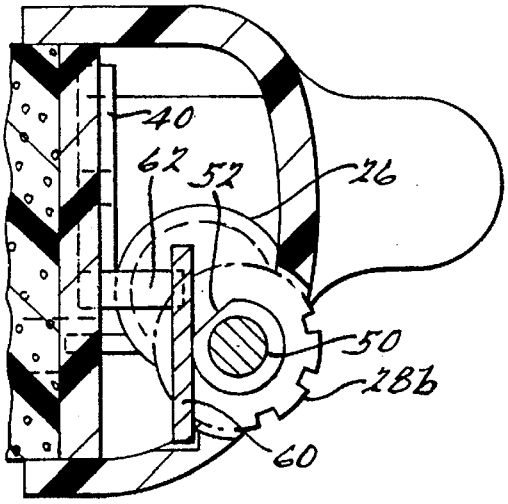
FIG. 6 is a view taken along the line 6—6 of FIG. 5.
Figure 7:
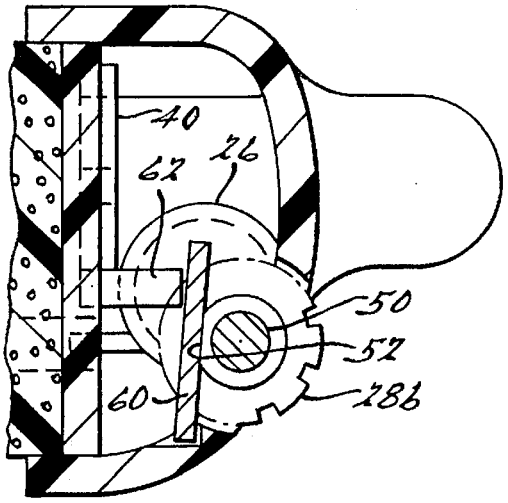
FIG. 7 is a view similar to FIG. 6 showing the lock in the open condition.

The combination lock 30 comprises three indexing wheels 28*a*, 28*b* and 28*c*, which are journaled on a lock shaft 50. Each of the wheels 28 is provided with a flat chord, one of which is seen in FIGS. 6 and 7 and designated by the numeral 52. As best seen in FIG. 6, when any one of the flat chords 52 on the indexing wheels 28*a*, 28*b* and 28*c* is at rotational position not indicative of the lock combination, a lock plate 60 is rotated counterclockwise to the lock position. In this position, the lock plate 60 is aligned with an end portion 62 of the latch plate 40 to preclude movement of thereof under the bias of the push button 26.

As best seen in FIG. 7 of the drawings, removal of the gun trigger lock 10 from the gun 20, is initiated by dialing the proper combination on the wheels 28*a*, 28*b* and 28*c* of the lock 30 thereby aligning the chords 52 thereon and conditioning the lock plate 60 for movement clockwise under the bias of a lock plate spring 64. Clockwise movement of the lock plate 60 clears the end portion 62 of the latch plate 40 and the teeth 38 thereon for movement under the bias of the push button 24.

Figure 8:
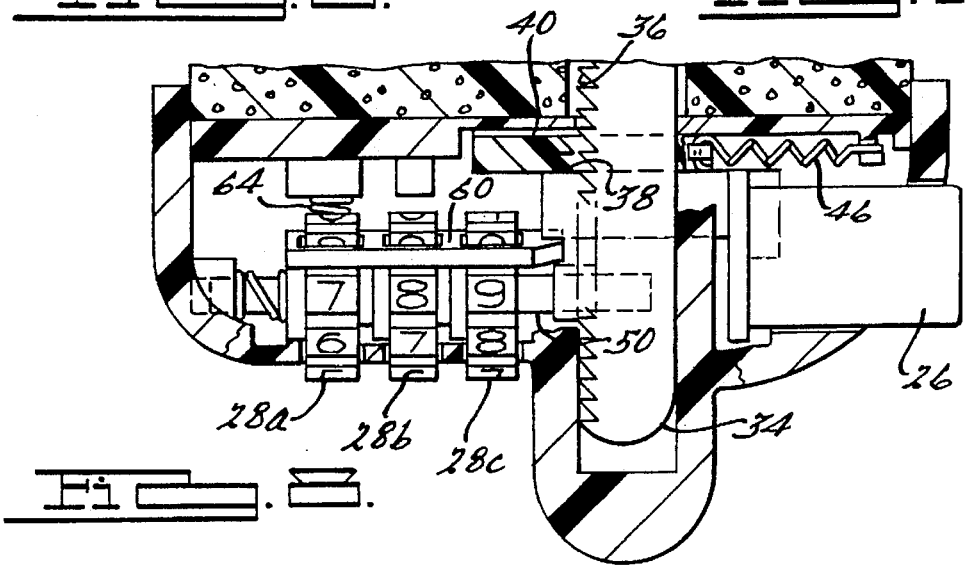
FIG. 8 is a view taken in the direction of the arrow 8 of FIG. 3.

As best seen in FIG. 8 of the drawings, the latch plate 40 has moved to the left relative to the combination lock plate 60, thereby moving the teeth 38 on the latch plate 40 to the left freeing the teeth 36 and conditioning the connecting shaft 34 for movement thereby conditioning the housings 12 and 14 for dissociation.

While the preferred embodiment of the invention has been disclosed, it should be appreciated that the invention is susceptible of modification without departing from the scope of the following claims.

We claim:

1. A trigger lock for a gun having a handle, a trigger and a trigger guard, said lock comprising:

a first housing overlying the trigger and trigger guard of said gun on one side and having a connector shaft with a plurality of teeth thereon extending through the trigger guard of the gun forwardly of the trigger thereof;

a second housing complementary to said first housing and overlying the trigger guard and trigger on the opposite side thereof from said first housing;

a latch plate carried by said second housing having a plurality of teeth thereon complimentary to and engageable with the teeth on the connector shaft on said first housing to effect locking of said housings to one another about the trigger guard on said gun;

a pair of elastomeric pads in said housings, respectively, compressible about the trigger guard and trigger of said gun when said housings are locked to one another thereby to preclude movement of the trigger of said gun; and a release button on said second housing facing the handle of the gun so as to be operable by the thumb of a users hand that is holding the gun for disengaging the teeth on said latch plate from the teeth on the connector shaft of said first housing to permit disassociation of said housings from one another and from said gun.

2. The trigger lock of claim 1 wherein said second housing is disposed on the side of the trigger guard of the gun on which the thumb on a users hand is disposed.

3. The trigger lock of claim 1 including a combination lock on said second housing openable to condition said release button for movement.

4. The trigger lock of claim 1 wherein said elastomeric pads are of 52 durometer foam on the Shore 00 scale.

* * * * *